US007704102B2

(12) United States Patent
Nad

(10) Patent No.: US 7,704,102 B2
(45) Date of Patent: Apr. 27, 2010

(54) CONNECTING ELEMENT COMPRISING A HOUSING FOR TELECOMMUNICATIONS AND/OR DATA CABLES

(75) Inventor: Ferenc Nad, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/063,967

(22) PCT Filed: Aug. 4, 2006

(86) PCT No.: PCT/EP2006/007730

§ 371 (c)(1),
(2), (4) Date: Aug. 19, 2008

(87) PCT Pub. No.: WO2007/019974

PCT Pub. Date: Feb. 22, 2007

(65) Prior Publication Data

US 2009/0068901 A1 Mar. 12, 2009

(30) Foreign Application Priority Data

Aug. 17, 2005 (DE) ..... 10 2005 038 795

(51) Int. Cl.
*H01R 9/26* (2006.01)

(52) U.S. Cl. ..... 439/716; 439/532; 439/221; 439/94

(58) Field of Classification Search ..... 439/709, 439/716, 532, 94, 221
See application file for complete search history.

(56) References Cited

U.S. PATENT DOCUMENTS 3,299,391 A * 1/1967 Herrmann et al. ..... 439/94
4,250,916 A 2/1981 Hoffmann
5,291,553 A * 3/1994 Smith ..... 379/413.04
5,295,869 A 3/1994 Siemon et al.
5,582,520 A * 12/1996 Doudon ..... 439/106
5,797,756 A * 8/1998 Nad ..... 439/94

(Continued)

FOREIGN PATENT DOCUMENTS

DE 27 36 079 2/1979

(Continued)

OTHER PUBLICATIONS

International Search Report and Written Opinion mailed Nov. 16, 2006.

*Primary Examiner*—Truc T Nguyen
(74) *Attorney, Agent, or Firm*—Merchant & Gould P.C.

(57) ABSTRACT

The invention relates to a connecting element (1) having a housing, with attachment means for attachment of the housing to a mounting rail (4) being arranged on the lower face of the housing, and with at least one connection for telecommunications and/or data cables being arranged in the housing, in which case the housing is formed in at least two parts and comprises an upper part (2) and a lower part (3) which are latched to one another, with the attachment means for the mounting rail (4) being arranged on the lower part (3) and the upper part (2) having at least one holder (23) for the connection (34) with the lower part (3) being formed with at least one bearing and the upper part (2) being formed with a corresponding bearing holder via which the upper part (2) is attached to the lower part (3) such that it can pivot.

12 Claims, 5 Drawing Sheets

U.S. PATENT DOCUMENTS

| | | | | |
|---|---|---|---|---|
| 6,033,257 | A * | 3/2000 | Lake et al. | 439/502 |
| 6,652,295 | B1 * | 11/2003 | Glass et al. | 439/94 |
| 6,832,935 | B2 * | 12/2004 | Minowa et al. | 439/716 |
| 7,416,421 | B2 * | 8/2008 | Kapinos et al. | 439/94 |
| 7,516,927 | B2 * | 4/2009 | Portal | 248/221.11 |
| 2006/0216963 | A1 | 9/2006 | Dold | |

FOREIGN PATENT DOCUMENTS

| | | |
|---|---|---|
| DE | 41 12 651 | 10/1992 |
| DE | 41 19 829 | 12/1992 |
| DE | 197 44 662 | 6/1999 |
| DE | 200 12 572 | 2/2001 |
| DE | 100 18 353 | 12/2001 |
| DE | 100 61 709 | 6/2002 |
| DE | 20 2005 004 927 | 7/2005 |
| EP | 0 531 628 | 3/1993 |
| EP | 1213804 | 6/2002 |
| WO | WO 01/80259 | 10/2001 |

* cited by examiner

CONNECTING ELEMENT COMPRISING A HOUSING FOR TELECOMMUNICATIONS AND/OR DATA CABLES

The invention relates to a connecting element having a housing for telecommunications and/or data cables.

A connecting element of this generic type is already known from DE 20 2005 004 927 U1. The connecting elements are in this case normally snapped onto the mounting rail, which is generally in the form of a top-hat rail, directly alongside one another. In this case, handling by a fitter is extremely difficult because the packing density is as high as possible.

The invention is thus based on the technical problem of providing a connecting element which allows more user-friendly installation.

For this purpose, the housing is formed in at least two parts and comprises an upper part and a lower part, which are latched to one another, with the attachment means for the mounting rail being arranged on the lower part. The upper part has at least one holder for the at least one connection, with the lower part being formed with at least one bearing and the upper part being formed with a corresponding bearing holder, via which the upper part is attached to the lower part such that it can pivot. This makes it possible, first of all, for the lower part to be initially mounted on the mounting rail, and to be left on the mounting rail for disassembly. The upper part can then be fitted with the connection, and one or more cables can be connected to the connection. The upper part that has been prefabricated in this way can then be pushed on at an acute angle from above, so that the bearing holders snap onto the bearings. During this process, the upper part is located on a free plane, thus providing maximum handling freedom. For attachment, the upper part can be pivoted downwards until the upper part and the lower part latch. During disassembly, the latch is released in a corresponding manner, and the upper part is pivoted out. In this case, it is possible in particular to provide for the bearing holder to slide out of the bearing at a specific angle, in order to make it easier to remove the upper part. The connection is preferably in the form of a plug socket, and furthermore preferably in the form of RJ45 socket.

In one preferred embodiment the bearings are in the form of two cylindrical pins which are arranged on the outer sidewalls of the lower part.

In a further preferred embodiment, the cylindrical pins are chamfered. This on the one hand makes it easier to push on the upper part, and to slide down the bearing holder while being pivoted up.

In a further preferred embodiment, the bearing holder is in the form of a lug with holes. This can be produced easily and ensures that the pivoting mechanism is sufficiently robust.

In a further preferred embodiment, at least two connections are arranged in the housing, are arranged parallel to one another and are aligned inclined with respect to the upper face of the upper part. In this case, the expression parallel means that the inlet surfaces of the connections form parallel planes. The inclined alignment allows the plug to be inserted conveniently at an angle from underneath, with the plugs not being impeded by the parallel offset.

In a further preferred embodiment, an electrically conductive ground trough is arranged in the lower part, by means of whose shielding elements the connections can be electrically connected to the mounting rail. The ground trough is in this case preferably a separate part, which is plugged into the lower part. The material used may be either metal or a metallized plastic.

Furthermore, the ground trough preferably has an essentially U-shaped cross section with lugs, which are cut out of the base plate and are bent outwards and lugs which are aligned upwards being arranged on the limb. In this case, the lugs which are bent out of the base plate are used to make contact with the mounting rail while, in contrast, the lugs which are directed upwards are used to make contact with shielding elements of the connections, for example with electrically conductive shield attachments.

In a further preferred embodiment, the connections each have an associated dust protective flap which can pivot and can be latched and is closed when no plug is inserted, thus preventing the ingress of dust and other foreign particles.

In one preferred embodiment, the dust protective flap has a curved element, which is arranged on the flap. The flap can then easily be opened by engaging in the curved element. In this case, it should be noted that the dust protective flap can also be used for other plug connectors, irrespective of the embodiment of the connecting element.

The invention will be explained in more detail in the following text with reference to one preferred exemplary embodiment. In the figures.

Figure 1:
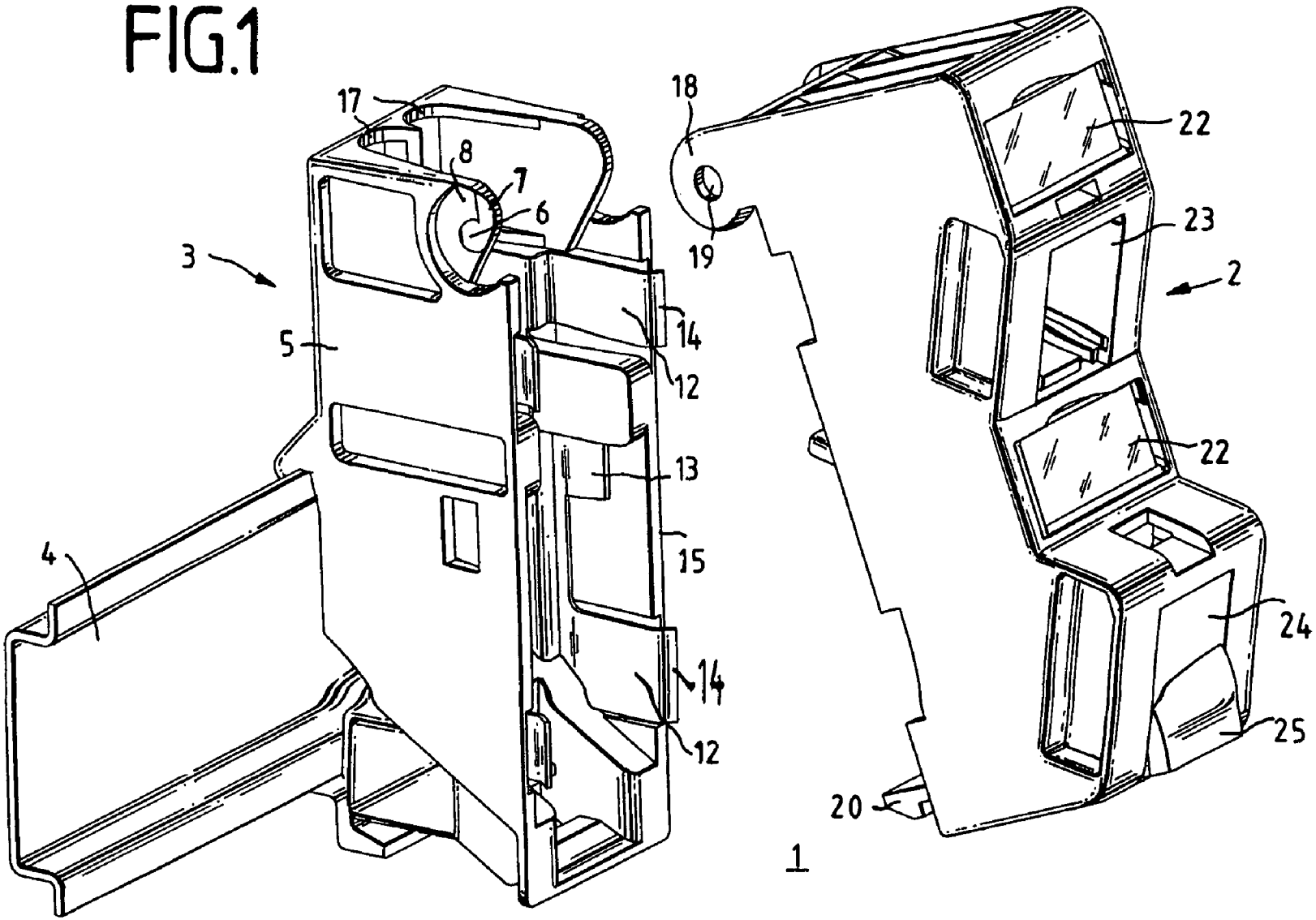
FIG. 1 shows a perspective illustration of a lower part latched onto a top-hat rail, and of a removed upper part.
Figure 2:
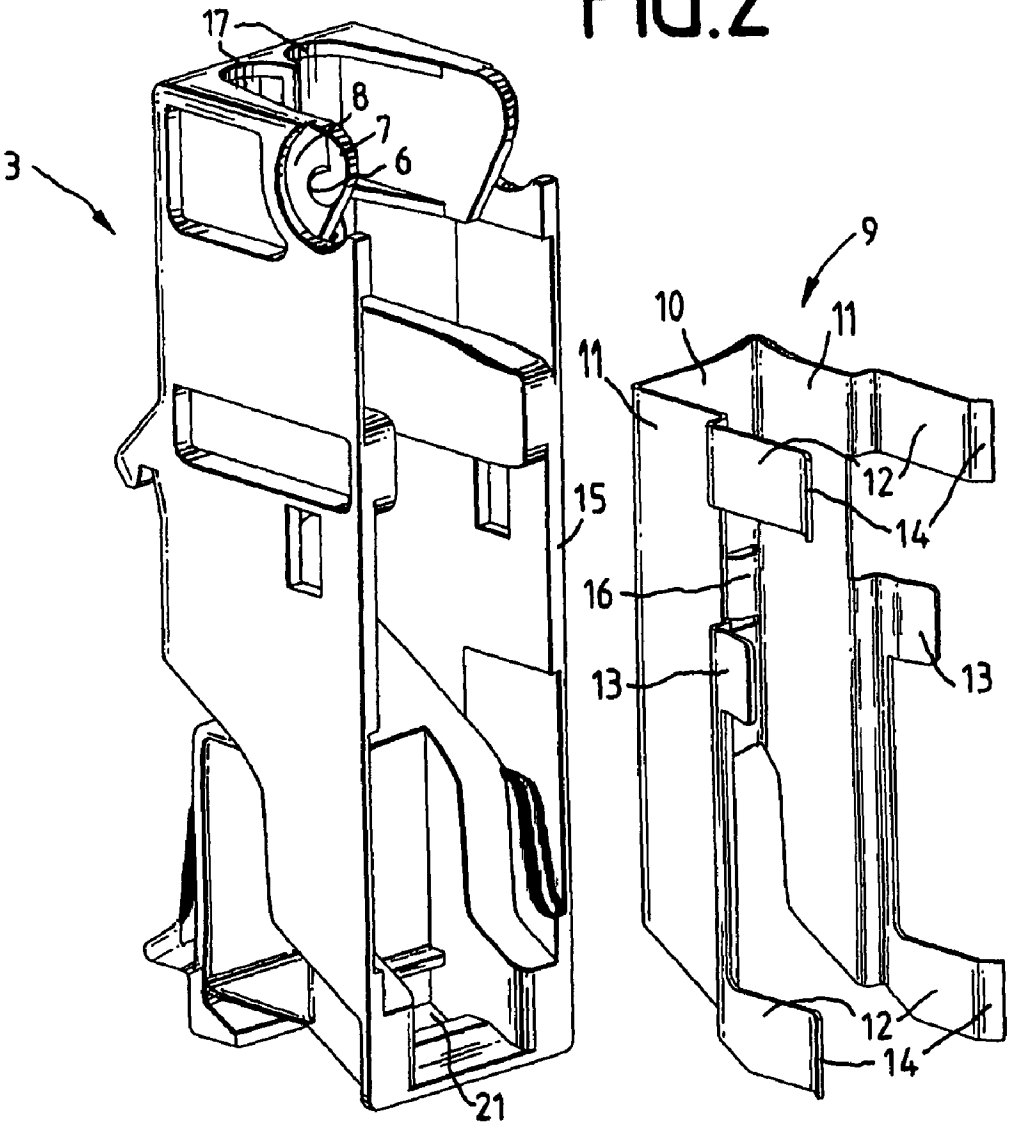
FIG. 2 shows a perspective illustration of the lower part, with the ground trough removed.

FIG. 1 illustrates the connecting element 1, comprising an upper part 2 and a lower part 3, with the lower part being latched onto a mounting rail 4 which is in the form of a top-hat rail. Two cylindrical pins 6, which are chamfered, are arranged in the upper area of the lower part 3, on the sidewalls 5. The chamfer is in this case designed such that it merges into a front flattened area 7, with the rear part of the pin 6 projecting beyond a rear area 8. A ground trough 9 is latched in the lower part 3. The precise shape of the ground trough 9 can be seen particularly clearly in FIG. 2. The ground trough 9 has an essentially U-shaped cross section. For this purpose, the ground trough 9 comprises a base plate 10 as well as two limbs 11. Lugs 12 which are directed upwards are formed on the limbs 11 and are used to make contact with shielding elements of the connections. A further lug 13 in each case extends approximately centrally from the limbs 11, is somewhat shorter than the lugs 12 and is used primarily for resting on and making contact with the lower part 3. In the assembled state, the upper, angled areas 14 of the lugs 12 project beyond the upper edge 15 of the lower part. Furthermore, two lugs 16 which are curved in the direction outwards in the direction of the mounting rail 4 are cut free from the base plate 10 and make contact with the mounting rail 4 when latched onto it. Furthermore, two cable guides 17 for the cables which are to be connected to the connections can be seen in the upper area of the lower part 3.

In the upper area, the upper part 2 has two lugs 18, which each have a hole 19. The lug 18 with the hole 19 is in this case used as a bearing holder for the pin 6. The chamfer on the pin 6 allows the lug 18 to slide easily over the pin 6 until it snaps into the hole 19. The upper part 2 can then be pivoted downwards until a latching element 20 on the upper part 2 snaps into a latching holder 21 in the lower part 3. The upper part 2 also has two inscription fields, which are each covered by transparent covers 22, which can preferably pivot, in order to protect them against dirt and moisture. The upper part 2 also has two holders 23 for connections, with the connections not yet having been inserted in FIG. 1. The connections are preferably in the form of shielded, RJ45 sockets, and in this case reference should be made to WO 02/15339 A1 for a preferred embodiment, in which an RJ45 socket such as this with shielding elements for connection of a cable shield is described.

The holders 23 for the connections are formed with a dust protective flap 24 which can pivot and can be latched, with a curved element 25 being arranged on the dust protective flap 24. The end face 26 of the curved element 25 extends to the end face 27 of the dust protective flap 24. Two sidewalls 28 are adjacent to the curved element 25 and each have a latching element 29 arranged on them, which can latch into a latching holder 30 in the holder 23. In order to ensure an adequate spring effect for the latching elements 29, the sidewalls 28 are not connected to the dust protective flap 24 in the area of the latching elements 29, but are separated by a slot 31 (see in particular FIGS. 4 and 5). Pins via which the dust protective flap 24 can be latched in on the upper part 2 such that it can pivot are arranged at the side on the dust protective flap, on the face opposite the curved element 25.

Figure 3:
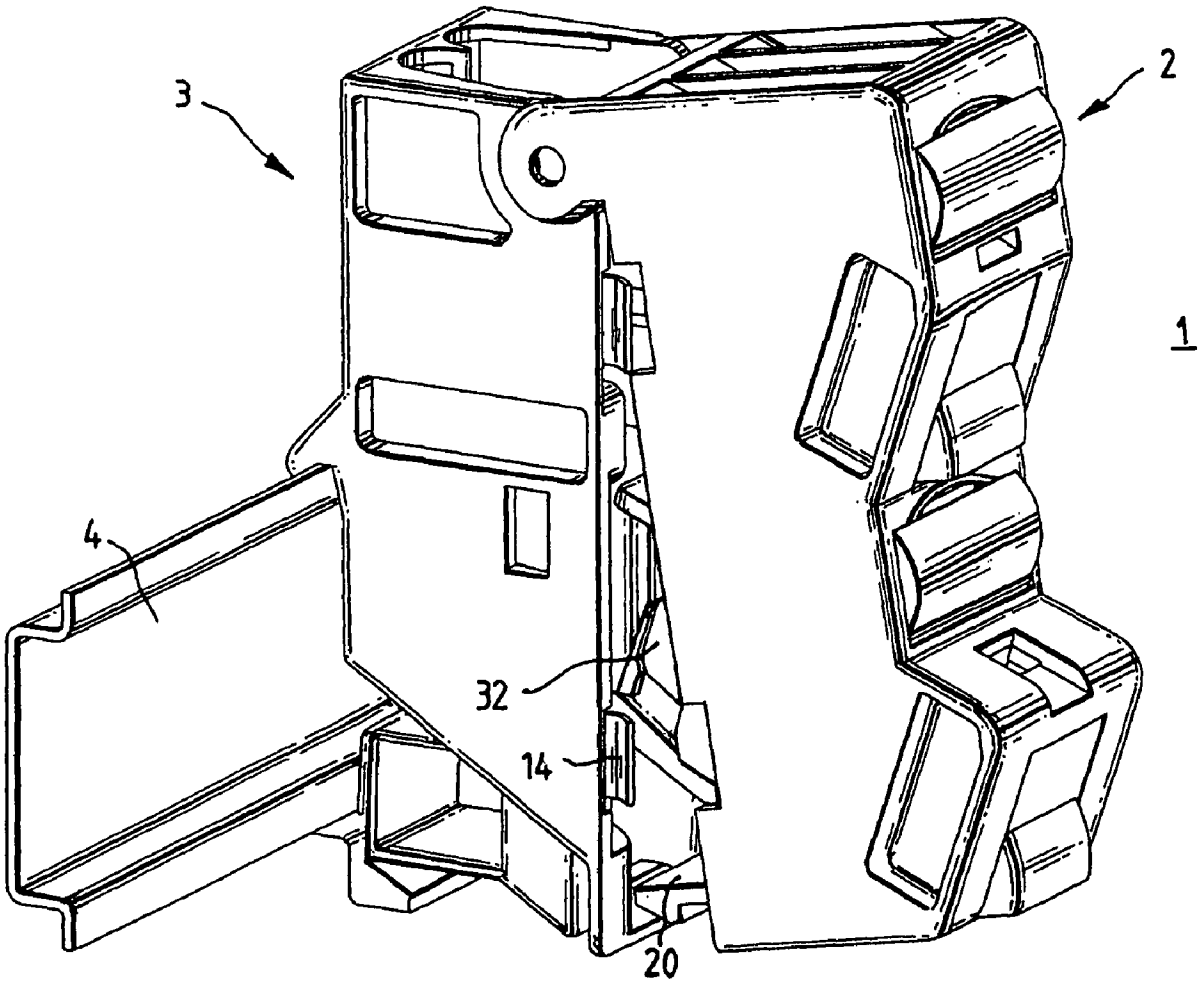
FIG. 3 shows a perspective illustration of the connecting element in the unlatched position.
Figure 4:
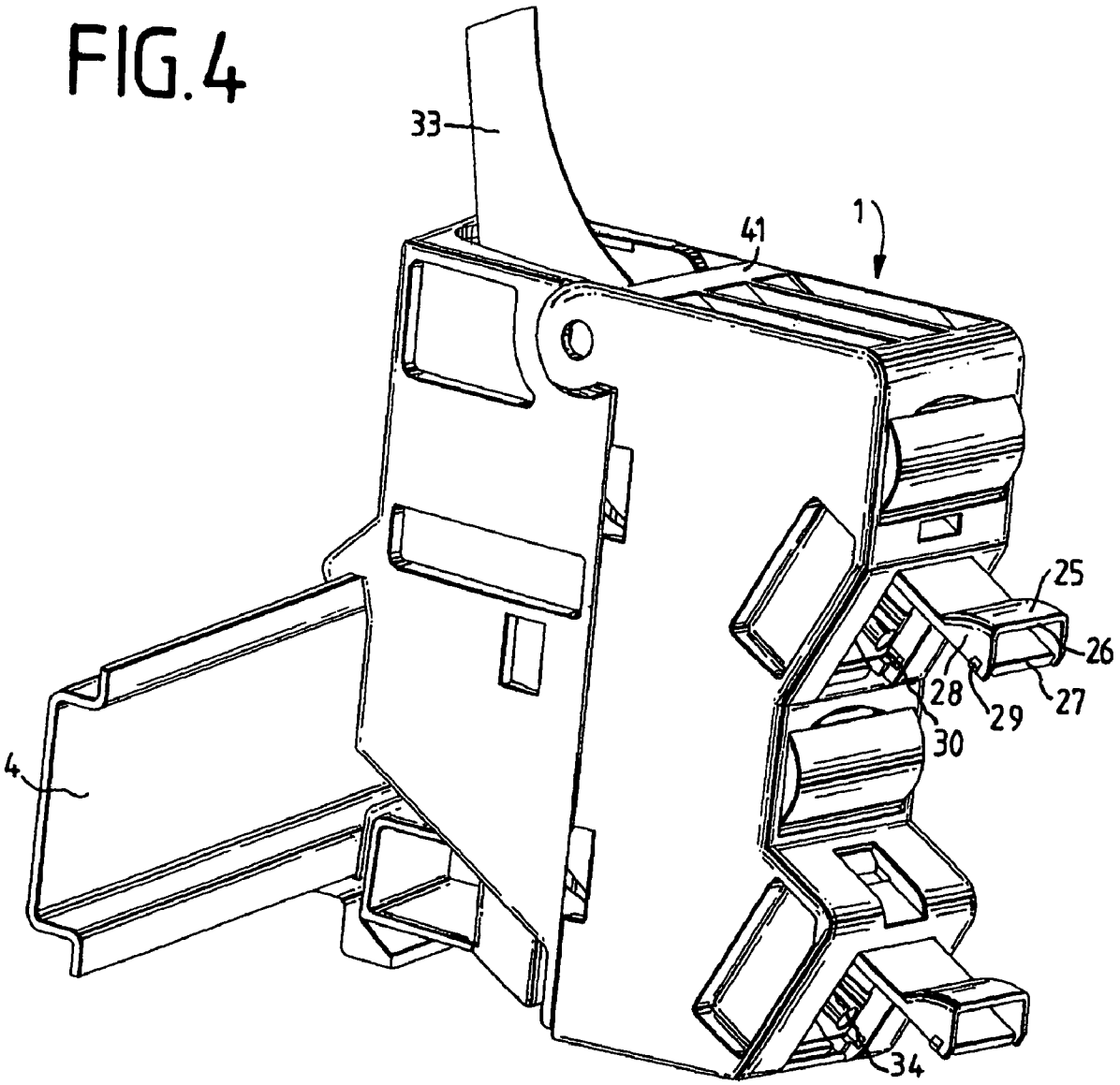
FIG. 4 shows a perspective illustration in the latched position.

FIG. 3 now shows the connecting element 1 shortly before the latching element 20 has been snapped into the latching holder 21 (see FIG. 2), which cannot be seen, in the lower part 3. In this case, the angled area 14 of the lug 12 can be seen, which makes contact with a shielding element 32 of the connection in the latched-in state. FIG. 4 also shows the position of a cable 33 in the cable guide 17 in the assembled state, as well as the connection 34 inserted in the holder.

Figure 5:
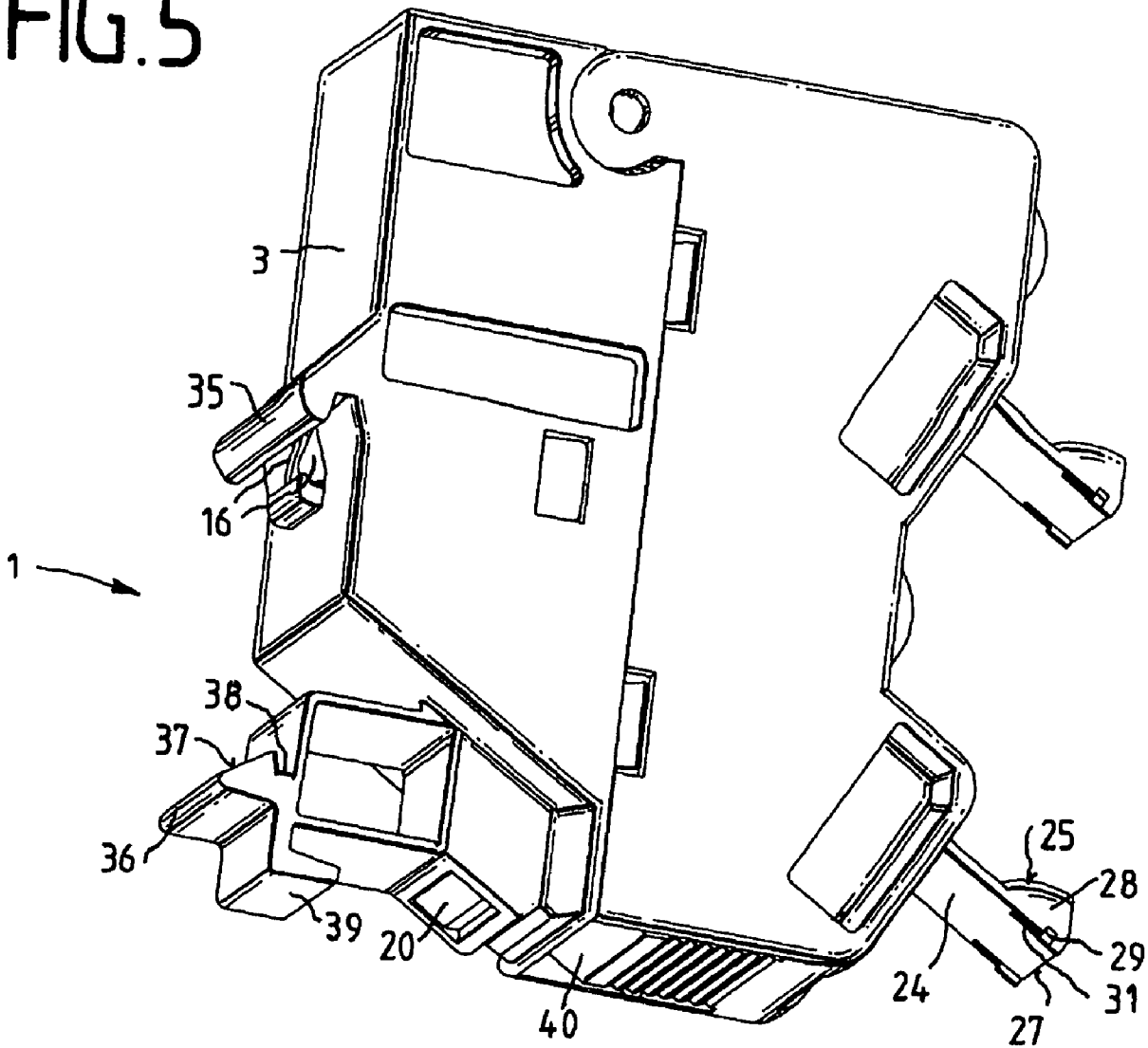
FIG. 5 shows a perspective view from underneath of the connecting element without the top-hat rail.

FIG. 5 shows the attachment means for mounting the lower part 3 on the mounting rail, which is the form of a top-hat rail. For this purpose, the lower part 3 has a first latching hook 35 and a second latching hook 36. In this case, the lower part 3 is inserted with the first latching hook 35 into the top-hat rail, and is then pushed down, with the lower part 3 being pressed along the incline 37 onto the top-hat rail until the edge of the top-hat rail slides into the groove 38. For removal, a disassembly web 39 is then bent by means of a tool until the edge of the top-hat rail slides out of the groove 38. A bracket 40 for unlatching the latching element 20 can also be seen.

For installation, the cores of the cable 33 are now connected to the connection or connections 34, which is or are latched into the holder 23 in the upper part 2 from the rear. The upper part is then hooked into the lower part over the pins 6, the cables 33 are passed upwards through the cable guides 17, and the upper part 2 is pivoted downwards. In this case, finally, it should be noted that the two holders 23 are arranged one above the other, on parallel offset planes. In this case, it is possible to accommodate two connections between the typical separations of the mounting rail 4. The planes are in this case arranged inclined with respect to the upper face 41 (see FIG. 4) of the upper part 2, so that the plugs to be connected to the connection 34 are connected obliquely from underneath.

LIST OF REFERENCE SYMBOLS

1 Connecting element
2 Upper part
3 Lower part
4 Mounting rail
5 Sidewall
6 Pin
7 Front area
8 Rear area
9 Ground trough
10 Base plate
11 Limb
12 Lugs
13 Lug
14 Angled area
15 Upper edge
16 Curved lug
17 Cable guide
18 Two lugs
19 Hole
20 Latching element
21 Latching holder
22 Cover
23 Holder
24 Dust protective flap
25 Curved element
26 End face
27 End face
28 Sidewall
29 Latching element
30 Latching holder
31 Slot
32 Shielding element
33 Cable
34 Connection
35 First latching hook
36 Second latching hook
37 Incline
38 Groove
39 Disassembly web
40 Bracket
41 Upper face

The invention claimed is:

1. A connecting element comprising:

a housing defining an upper face and a lower face, attachment means for attachment of the housing to a mounting rail being arranged on the lower face of the housing, and at least one connection for telecommunications and/or data cables being arranged in the housing, wherein the housing includes an upper part and a lower part which are latched to one another, the attachment means for the mounting rail being arranged on the lower part, the upper part having at least one holder for the connection, and the lower part includes sidewalls on which first and second pins are arranged and the upper part including first and second lugs each defining a hole configured to receive one of the pins of the lower part, wherein the upper part is pivotally attached to the lower part via the pins and holes.

2. The connecting element as claimed in claim 1, wherein the pins are chamfered.

3. The connecting element as claimed in claim 1, wherein at least two connections are arranged in the housing, are arranged parallel to one another, and are aligned obliquely with respect to the upper face of the housing.

4. The connecting element as claimed in claim 1, wherein an electrically conductive ground trough is arranged in the lower part wherein a shielding element of the at least one connection can be electrically connected to the mounting rail.

5. The connecting element as claimed in claim 1, wherein the at least one connection has an associated dust protective flap which can be pivoted and can be initially latched.

6. The connecting element as claimed in claim 4, wherein the ground trough has a U-shaped cross section with lugs, which are cut out of a base plate and are bent outwards and lugs which are aligned upwards being arranged on a limb.

7. The connecting element as claimed in claim 5, wherein the dust protective flap has a curved element which is arranged on the flap.

8. The connecting element as claimed in claim 7, wherein sidewalls are arranged on the curved element and are separated from the dust protective flap by a slot.

9. A connecting element comprising:

a housing defining an upper face and a lower face, attachment means for attachment of the housing to a mounting rail being arranged on the lower face of the housing, and at least one connection for telecommunications and/or data cables being arranged in the housing, wherein the housing includes an upper part and a lower part which are latched to one another, the attachment means for the mounting rail being arranged on the lower part, the upper part having at least one holder for the connection, and the lower part being formed with at least one bearing and the upper part being formed with a corresponding bearing holder via which the upper part is attached to the lower part such that the upper part is configured to pivot, wherein an electrically conductive ground trough is arranged in the lower part wherein a shielding element of the at least one connection can be electrically connected to the mounting rail, wherein the ground trough has a U-shaped cross section with lugs, which are cut out of a base plate and are bent outwards and lugs which are aligned upwards being arranged on a limb.

10. A connecting element comprising:

a housing defining an upper face and a lower face, attachment means for attachment of the housing to a mounting rail being arranged on the lower face of the housing, and at least one connection for telecommunications and/or data cables being arranged in the housing, wherein the housing includes an upper part and a lower part which are latched to one another, the attachment means for the mounting rail being arranged on the lower part, the upper part having at least one holder for the connection, and the lower part being formed with at least one bearing and the upper part being formed with a corresponding bearing holder via which the upper part is attached to the lower part such that the upper part is configured to pivot, wherein the at least one connection has an associated dust protective flap which is configured to be pivoted and to be latched initially.

11. The connecting element as claimed in claim 10, wherein the dust protective flap has a curved element which is arranged on the flap.

12. The connecting element as claimed in claim 11, wherein sidewalls are arranged on the curved element and are separated from the dust protective flap by a slot.

* * * * *